United States Patent [19]

Bouchard

[11] Patent Number: 4,720,129

[45] Date of Patent: Jan. 19, 1988

[54] IMPROVED TWO PIECE SECURITY PLATE FOR A DOOR

[76] Inventor: Donald J. Bouchard, 3920 S. Third Ave., Phoenix, Ariz. 85041

[21] Appl. No.: 899,644

[22] Filed: Aug. 25, 1986

Related U.S. Application Data

[63] Continuation-in-part of Ser. No. 684,571, Dec. 21, 1984, Pat. No. 4,629,231.

[51] Int. Cl.[4] ..... E05C 21/02

[52] U.S. Cl. ..... 292/346

[58] Field of Search ..... 292/340, 341.18, 337, 292/346

[56] References Cited

U.S. PATENT DOCUMENTS

| | | | |
|---|---|---|---|
| 3,405,962 | 10/1968 | Sushan | 292/346 |
| 3,764,173 | 10/1973 | Griffith | 292/346 |
| 3,934,910 | 1/1976 | Radke | 292/346 |
| 4,130,311 | 12/1978 | Sushan | 292/346 |
| 4,178,027 | 12/1979 | Charron | 292/346 |
| 4,183,568 | 1/1980 | Ferracane | 292/346 X |
| 4,390,190 | 6/1983 | Taylor | 292/346 |
| 4,458,931 | 7/1984 | McBurnie | 292/346 |

*Primary Examiner*—Richard E. Moore
*Attorney, Agent, or Firm*—M. David Shapiro

[57] ABSTRACT

The invention comprises a combination security plate for attachment to a door edge over or in conjunction with a latch set, the security plate providing protection against incursion of a credit card or other light burglary tool directed to the latch or to destruction of the latch area of the door or door stop. The combinational aspect of the design of the invention acts to protect both sides of a door so can thus be utilized on an outwardly or inwardly opening door. The security plate of the invention may be also be attached to either a left or right opening door without modification and in combination with the use on inward and outward opening applications. In those applications where only one side of the door needs protection, the plate may be easily broken into two parts so that each part may be used, respectively, on an inward and an outward opening door. A minor change in design of the security plate allows slightly better protection of the door in the area between a door knob escutcheon plate and the edge of the door on the door stop side of the door. An auxiliary plate provides nearly the same protection to the door stop material where the latter embodiment is employed.

4 Claims, 8 Drawing Figures

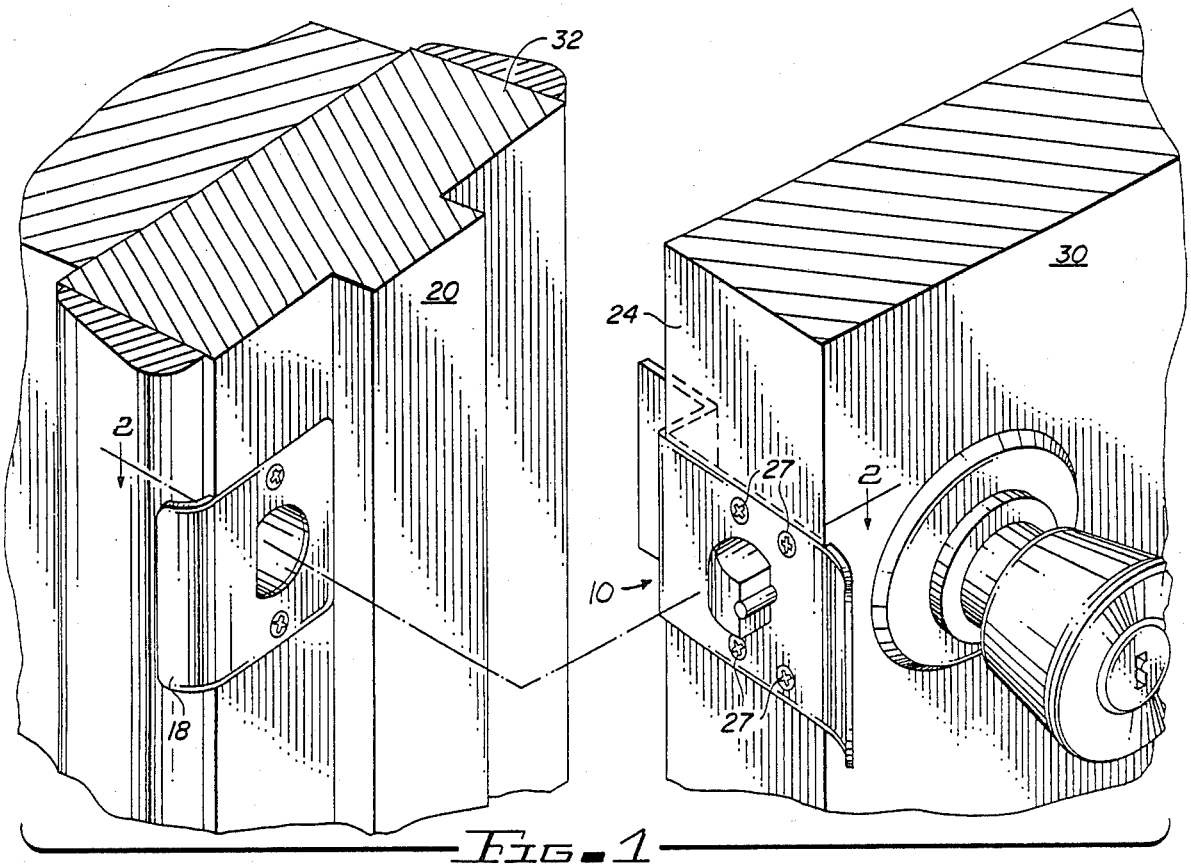
FIG. 1
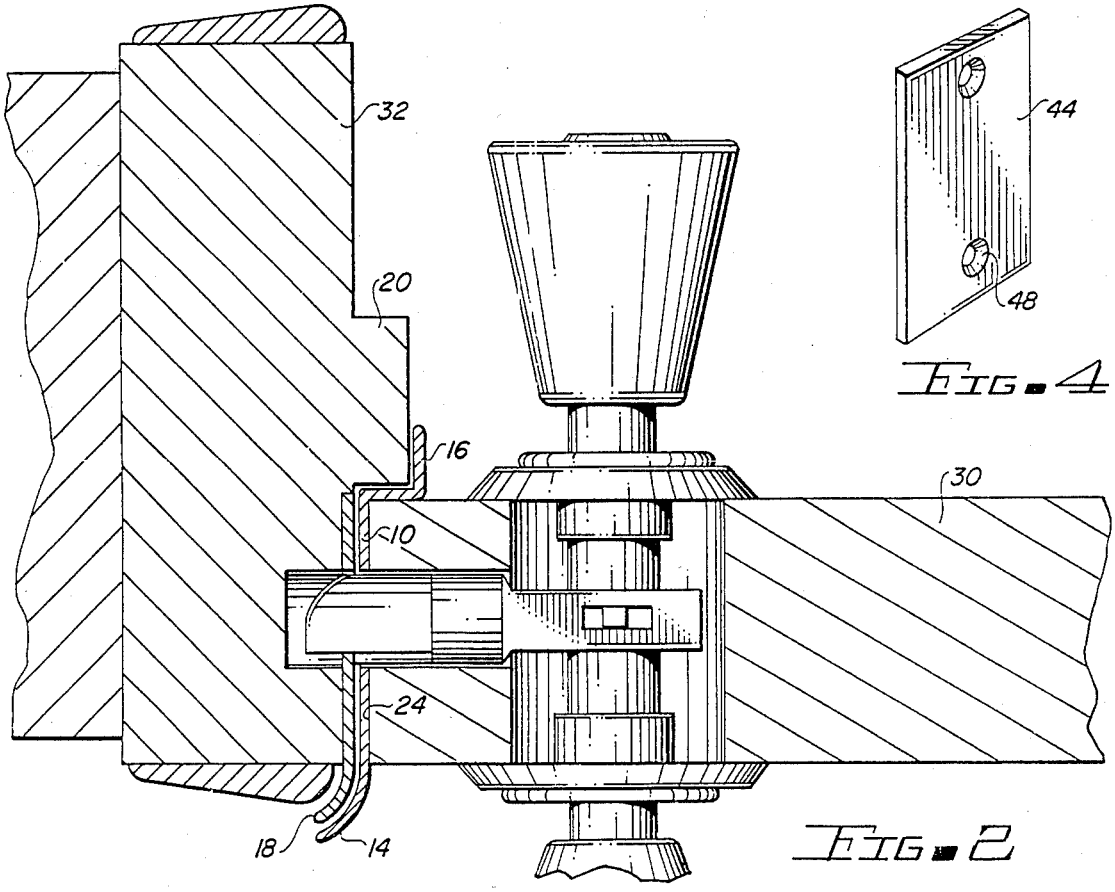
FIG. 2
FIG. 4

IMPROVED TWO PIECE SECURITY PLATE FOR A DOOR

This application is a Divisional Continuation-in-Part of co-pending application Ser. No. 684,571 filed on Dec. 21, 1984, entitled "Improved Security Plate for A Door", now U.S. Pat. No. 4,629,231, issued on Dec. 16, 1986.

FIELD OF THE INVENTION

The invention relates to an improved security plate for a door latch or for a door bolt of the type which is designed to prevent unauthorized entry through the door. The invention comprises a security plate which may be optionally combined with the latch or bolt plate and may serve on either an outward, or inward swinging door, or both, at the option of the installer.

BACKGROUND OF THE INVENTION

It is well known that it is common practice to use a credit card or a similar thin, flexible instrument to disengage a door latch in a door for the purpose of illegal entry there through. The instrument is placed between the door and the jamb at the position of the latch mechanism and is used to force the latch bolt back into the door (out of the striker plate) to allow opening of the door.

Guard plates for the prevention of such illegal entry are commonly sold. Many institutions fabricate such plates for use in their facilities. These prior art security plates are believed to be designed and fabricated to fit a particular door/latch set combination, depending upon whether the door opens inward (toward the area to be secured) or outward (away from the area to be secured. U.S. Pat. Nos. 3,888,530, issued to Fabrici; 3,764,173 issued to Griffith; 2,144,075, issued to Mora; 4,183,568, issued to Ferracane; 3,761,119, issued to Bennett et al.; and 3,405,962, issued to Sushan, are illustrative of the state of the art.

These prior art designs are intended for use on only one side of a door and are not adaptable to either outward or inward opening doors.

Attention is also brought to my previous application for patent on a Double Purpose Security Plate, filed on Mar. 2, 1984 and bearing application Ser. No. 585,924 now U.S. Pat. No. 4,583,776, issued on Apr. 22, 1986.

SUMMARY OF THE INVENTION

These and other problems demonstrated by prior art security plates are resolved by means of the present invention. The design of the instant invention is, unlike my previous invention, supra, intended for application on the edge of the door surrounding the latch or bolt and it optionally may be incorporated as a part of the latch or bolt plate in the edge of the door. Furthermore, it may be installed on a left or right, inward or outward opening door. Still further, it may optionally be broken apart to service two different doors, if that is perceived to be desirable; provided that one of the two doors is to open outwardly and the other to open inwardly. The bent features of the ends of the plate of this invention are intended to protect the latch or bolt from access by means of a credit card or light burglary tools such as a small screwdriver. An auxiliary flat security plate may be supplied to allow a slightly different configuration of the bent plate.

It is therefore, an object of the invention to provide a single security plate which may be used on inwardly, outwardly, right or left opening doors either in combination with a conventional prior art latch or bolt set or integrally combined with such set by incorporating the latch or bolt plate into the security plate of the instant invention.

It is another object of the invention to provide a security plate which can, at the installer's option, be broken apart and used to protect two different door latch or bolt sets where the two doors upon which they are to be installed have differing opening directions; inward and outward.

It is still another object of the invention to provide a security plate which is adaptable to a variety of bolt or latch set sizes and setbacks.

It is a still further object of the invention to provide an improved two piece security plate for a door and a cooperating door frame.

These and other objects of the invention will be more readily understood upon review of the Detailed Description of the Invention, below, together with the accompanying drawings in which:

FIG. 1 reveals a perspective view of the preferred embodiment of the invention as installed on a door and door frame;

FIG. 2 illustrates a cross sectional view of the invention of FIG. 1 taken at 2—2;

FIG. 4 is a perspective view of an auxiliary flat security plate used with some embodiments of the invention;

DETAILED DESCRIPTION OF THE INVENTION

FIGS. 1 and 2 are illustrative of the best embodiment of the invention as installed in a typical application. The best embodiment of security plate 10 is shown in FIGS. 5–7.

Figure 5:
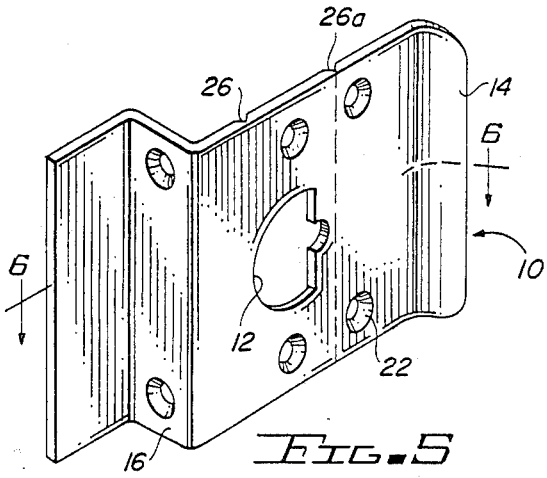
FIG. 5 is a perspective view of a separate security plate of the invention as shown installed in FIGS. 1 and 2.

Consider, first, FIG. 5. Security plate 10 has shaped hole 12, there through, which is shaped to fit a latch or bolt as shown in FIGS. 1 and 2. Security plate 10 has a bent or curved end 14 and "L" shaped end 16. Curved end 14 is shaped to closely fit the curve in striker plate 18 and to extend somewhat beyond it (shown in FIGS. 1 and 2). "L" shaped end 16 is bent to conform to door stop 20 (shown in FIGS. 1 and 2). Countersunk holes 22 are provided for mounting security plate 10 on door edge 24 by means of flat head screws 27. FIG. 6 is a cross sectional view of security plate 10 taken at 6—6 of FIG. 5. It may be seen, there, that security plate 10 has two grooves 26, **26*a* fabricated therein. Groove 26 may be used to facilitate the removal of "L" shaped end 16, together with a portion of the straight section of plate 10, designated in combination as reference numeral 28. Groove 26*a* may be used to facilitate removal of curved end 14 of security plate 10, together with a portion of straight section of plate 10, designated in combination as reference numeral 28*a*. (See FIG. 6**.)

Removable section 28 of security plate 10 may be applied for security purposes separately to another door (not shown), where that door is an inward opening door and the remainder of security plate 10 would then be useful only on an outward opening door. Removable section 28*a* could be removed and used in a similar manner on an outwardly opening door. It should be noted that security plate 10 (either as a whole or as the part remaining when section 28 is removed) and section 28 (as removed) may be applied to either a left or right hand opening door.

Figure 6:
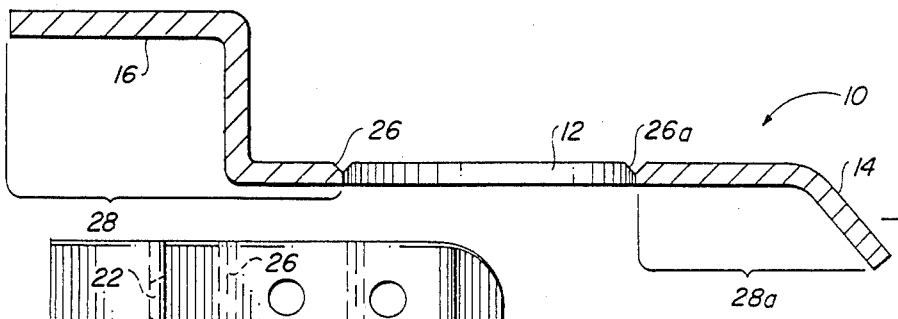
FIG. 6 is a cross sectional view of the plate of FIG. 5 taken at 6—6.
Figure 7:
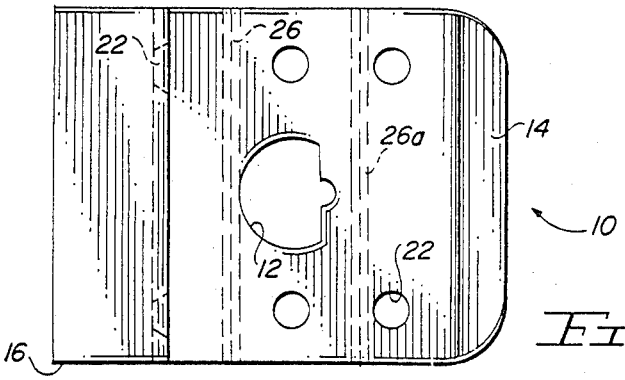
FIG. 7 is a front view of the plate of FIGS. 5 and 6.

FIG. 7 is provided for additional clarity and is a front view of security plate 10 as previously shown in FIGS. 5 and 6.

In use, security plate 10 is applied to edge 24 of door 30 as shown in FIGS. 1 and 2. Plate 10 may be let into (flush mount) door 30 edge 24 as shown, or it may be mounted on the surface of edge 24. In either case, when door 30 is closed, the shape of plate 10 is such that there is a good fit between striker plate 18 on door frame (or jamb) 32 and curved end 14 of security plate 10. There is also a similar good fit between "L" shaped end 16 of security plate 10 and door stop 20.

Of course, if section 28 is broken away from security plate 10, "L" shaped end 16 is not available for security use. This is of no moment in those cases where the door is intended to open outwardly since there is no need for security on the interior of an outwardly opening door in most instances. Should an application arise which requires security on both sides of a door, the option remains to elect not to remove section 28.

Figure 3:
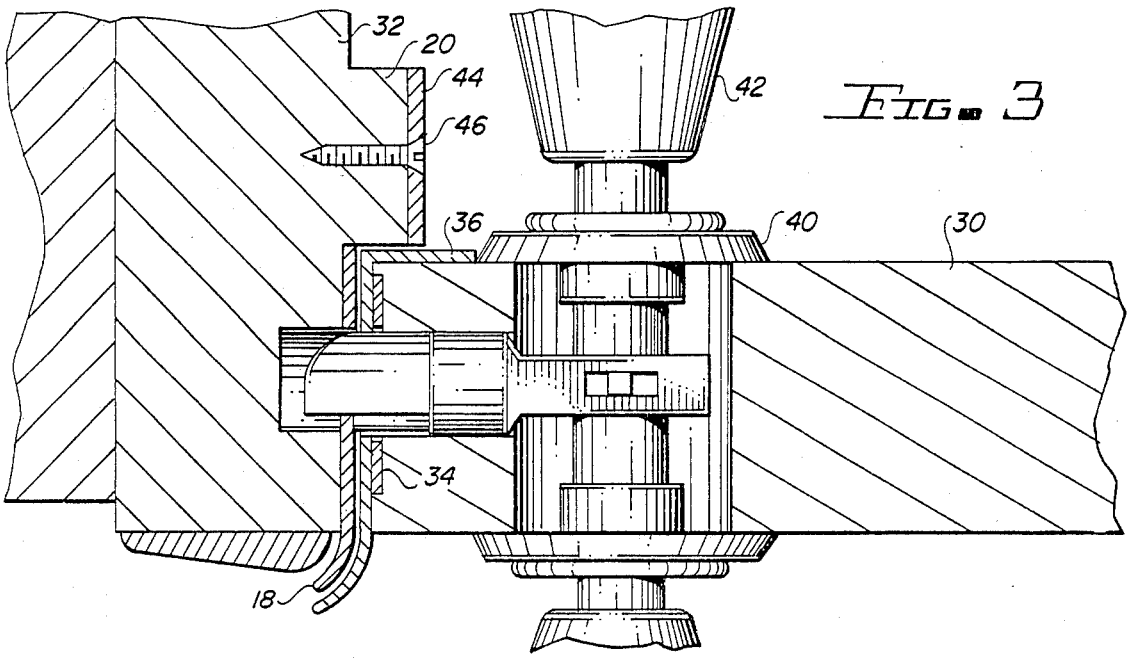
FIG. 3 is similar to FIG. 2 but shows an alternative configuration of the security plate of the invention.

It should be noted that the configuration shown in FIGS. 1 and 2 are illustrative of an integrated latch or bolt plate with security plate 10. That is, security plate 10 is supplied by the manufacturer of the latch or bolt set and there is no separate latch or bolt plate required. FIG. 3, to be described below, is illustrative of a separate security plate according to the invention and latch or bolt plate 34. It will be understood that security plate 38 of FIGS. 3 and 8 and security plate 10 may each be designed into an integrated latch set by the manufacturer of same or may each be supplied separately for surface installation in the aftermarket. Where the security plate is to be provided as an integral part of the latch or bolt set, hole 12 should conform to the cross section of the latch or bolt, as shown in FIG. 5, for example. Where the security plate is to be furnished to an aftermarket user, a larger clearance hole 12a, as shown in FIG. 8, should be employed.

Hole 12*a* is preferrably made to have a diameter of about 1 1/16 inches. This dimension is preferred because it allows security plate 38 to be used on either a $1\frac{3}{8}$, a $1\frac{3}{4}$, or a 2 inch thick door 30. In installation, hole 12*a* would be centered on the edge of a standard $1\frac{3}{4}$ inch thick door 30 as shown in FIG. 3. By offsetting plate 38 in one direction, the same plate may be installed on a $1\frac{3}{8}$ inch door. By offsetting plate 38 in an opposite direction, plate 38 may be installed on a 2 inch thick door. Where the mounting holes (not referenced by numerals, but located on the same vertical center line as hole 12*a*, FIG. 8) for plate 38 are spaced appropriately far enough apart to clear plate 34 (see, FIG. 3) these mounting holes may be used to attach plate 10 to the edge of door 30 by means of suitable screws, thereby not interferring with the normal use of the bolt or latch set and its plate 34 in those cases where plate 38 is mounted off the center line of door 30.

Figure 8:
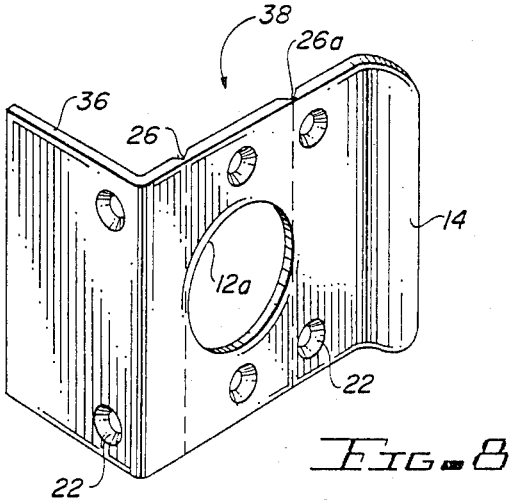
FIG. 8 is a perspective view of a security plate slightly modified from that of FIG. 5.

An alternative embodiment of the security plate of the invention is illustrated in FIG. 8 and is referred to generally as reference numeral 38. There, the shape of the door stop end of plate 38 is straightened (with respect to the plate of FIGS. 5–7). Straight portion 36 is adapted to lie flat of door 30 (see FIG. 3) adjacent escutcheon plate 40 of door knob 42. This configuration provides a higher degree of protection for the door structure adjacent the latch mechanism than does the configuration of security plate 10 of FIGS. 5–7. However, to more fully protect door stop 20, an auxiliary plate 44, seen in FIG. 4, should be provided. It is intended for installation on door stop 20, as shown in FIG. 3, to prevent gouging of door stop 20 with light burglary tools, such as a screw driver or the like. Auxiliary plate 44 is mounted by means of screws 46 through countersunk mounting holes 48. Phillips head or special security head screws may be used to discourage unauthorized removal of plate 44. Auxiliary plate 44 thus acts in cooperation with straight ended security plate 38 to provide nearly the same degree of protection as would have been provided by one piece security plate 10 which integrally incorporates "L" shaped end 16.

Plate 44, as shown in FIGS. 3 and 4, may be shaped to further protect door stop 20. This may be accomplished by putting an "L" shape on either or both ends of plate 44 and installing plate 44 so that the added "L" shapes wrap around either or both short sides of door stop 20 in addition to the protection offered the face of door stop 20 by plate 44 as shown.

While the invention has been particularly shown and described with reference to a preferred embodiment thereof, it will be understood by one of ordinary skill in the art that various other modifications and changes may be made to the present invention from the principles of the invention described above without departing from the spirit and scope thereof, as encompassed in the accompanying claims. Therefore, it is intended in the appended claims to cover all such equivalent variations which do essentially the same thing in essentially the same way to produce the same result as those equivalent variations come within the scope of the invention as described.

What is claimed is:

1. An improved swingable door two piece security plate assembly set, the improved two piece security plate assembly set preventing the use of a credit card or the like from being used to retract a latch on a door, when the door is in a closed position, from a cooperating standard striker plate which is installed on a mating jamb, the mating door jamb being equipped with a door stop, the latch being a portion of a latch set, the two piece security assembly set comprising in combination:

a swingable door having a hinge set mounted on an edge thereof and having the latch set mounted on an opposite edge thereof;

plate means for covering at least a portion of said door stop in a vicinity adjacent the striker, said plate means being fastened to said door stop; and a double ended security plate mounted on said opposite edge of said door over the latch, said double ended security plate further comprising:

a main body having hole means therethrough for clearing the latch;

a first end forming an "L" shape cross section with said main body, said "L" shape having a first leg thereof oriented approximately perpendicular to said main body, a second leg of said "L" shape being the main body, said first leg of said "L" shape being interposed between said door and said door stop when said door is in a closed position, said first and said second legs being connected at a corner of the door where said edge of the door and said face of the door meet; and a second end having a curved shape, said curved shape having a curve to correspond to a shape of the striker plate, said curved shape being adjacent to the striker plate when said door is in a closed position.

2. The improved swingable door two piece security plate assembly set according to claim 1 wherein said main body further comprises:

groove means for facilitating separation of said main body into at least two portions, a first portion of said at least two portions of said main body including said first end and a second portion of said at last two portions of said main body including said second end.

3. The improved swingable door two piece security plate assembly set according to claim 1 wherein said main body of said two piece security plate assembly is an integral part of the latch set.

4. The improved swingable door two piece security plate assembly set according to claim 2 wherein said main body of said two piece security plate assembly is an integral part of the latch set.

* * * * *